United States Patent [19]

Pfleiderer

[11] Patent Number: 4,589,128

[45] Date of Patent: May 13, 1986

[54] PROCESS FOR THE PRODUCTION OF A SOUND RECORDING AND A DEVICE FOR CARRYING OUT THE PROCESS

[75] Inventor: Peter M. Pfleiderer, Munich, Fed. Rep. of Germany

[73] Assignee: Boeters, Bauer & Partner, Fed. Rep. of Germany

[21] Appl. No.: 519,990

[22] Filed: Aug. 3, 1983

Related U.S. Application Data

[63] Continuation of Ser. No. 260,938, May 6, 1981.

[30] Foreign Application Priority Data

May 9, 1980 [DE] Fed. Rep. of Germany ..... 3017854
Mar. 31, 1981 [DE] Fed. Rep. of Germany ..... 3112874

[51] Int. Cl.[4] ..... H04R 5/04
[52] U.S. Cl. ..... 381/17; 381/25
[58] Field of Search ..... 381/17, 25

[56] References Cited

U.S. PATENT DOCUMENTS 3,970,787 7/1976 Searle ..... 381/25
4,188,504 2/1980 Kasuga et al. ..... 381/17

FOREIGN PATENT DOCUMENTS 1148269 12/1960 Fed. Rep. of Germany .

OTHER PUBLICATIONS

Radio Electronics, Jul. 1976, pp. 43–45.
Funkschau, 1979, No. 1, pp. 39 and 84.

*Primary Examiner*—R. J. Hickey
*Attorney, Agent, or Firm*—Bierman, Peroff & Muserlian

[57] ABSTRACT

A process for the reproduction of a sound recording using headphones as the reproduction device, comprising connecting between the sound carrier and the reproduction device a reverberation reproducer, producing reverberation reflections within a period of approximately 50 ms, at least some of which if triggered by pulses occurring simultaneously in both channels of the sound carrier are delivered at time intervals from each other so that they are perceived by the listener as sound-intense signal reflections by themselves, at least some of the single reflections consisting of two pulses being triggered by a direct sound pulse from a channel of the sound carrier and of which the first is emitted over the channel of the reproduction devices that is assigned to the corresponding sound carrier channel and the second is somewhat weaker and is emitted over the other channel of the reproduction devices with a time delay with respect to the first pulse of approximately 0.2 to 1 ms so that reverberation reflections are damped in dependence upon the sound frequency.

2 Claims, 6 Drawing Figures

Figures 1, 1A, 1B, 1C:
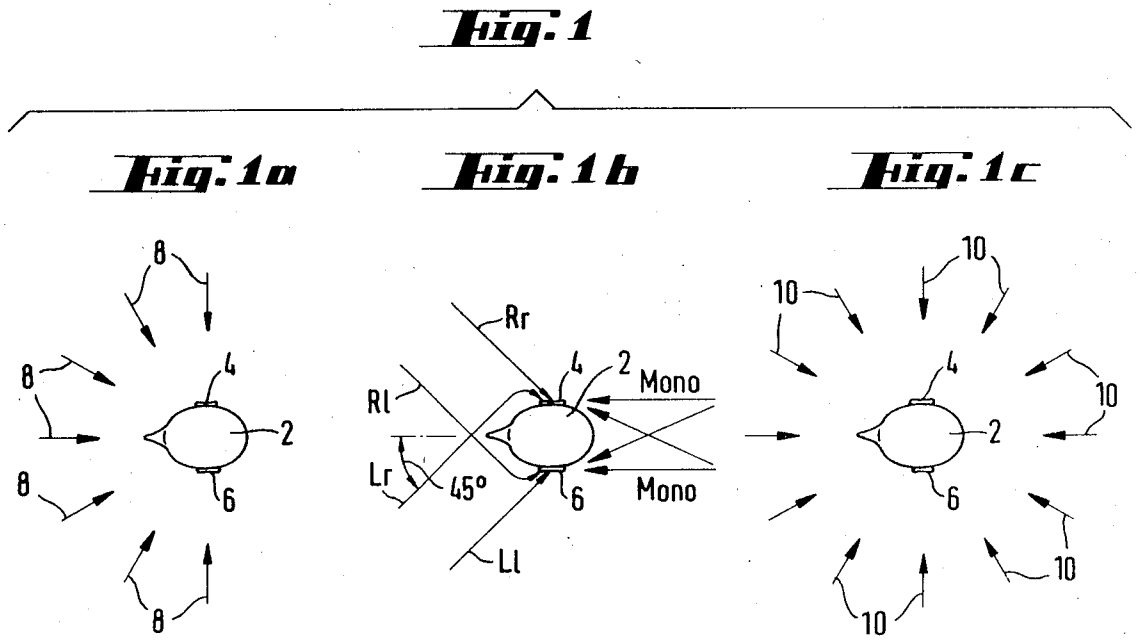

2
4
6
8
10
Mono
Mono
Rr
Rl
Lr
Ll
45°

PROCESS FOR THE PRODUCTION OF A SOUND RECORDING AND A DEVICE FOR CARRYING OUT THE PROCESS

This is a continuation of Ser. No. 260,938, filed May 6, 1981.

The invention relates to a process for the reproduction of a sound recording, using headphones as the reproduction device, wherein between the sound carrier and the reproduction device there is connected a reverberation producer which, within a period of approximately 50 ms, produces reverberation reflections at such time intervals, preferably of more than 2 ms, that they are still perceived by the listener as sound-intense individual reflections, at least some of the individual reflections consisting of two pulses which are triggered by a direct sound pulse from a channel of the sound carrier and of which the first is emitted over the channel of the reproduction devices that is assigned to the corresponding sound carrier channel (for example, right) and the second is somewhat weaker and is emitted over the other channel (left) of the reproduction devices with a time delay with respect to the first pulse of approximately 0.2 to 1 ms, preferably approximately 0.63 ms, This production process considerably improves spatial sound reproduction, in the case of headphones where the localisation of the sound event in the head is to be avoided.

The problem underlying the application is, therefore, to develop a process of the type described at the beginning in such a manner that a spatial sound reproduction is achieved that is felt to be as natural as possible.

According to the invention this problem is solved by damping the reverberation reflections in dependence upon the sound frequency. The individual reflections, each of which consists of two separate pulses, are damped increasingly in volume with respect to the direct sound as the time interval from the direct sound increases, it being possible for the trebles to be slightly more strongly damped. It is especially important, however, in the case of the two pulses that together form a reverberation reflection, that the second pulse only be damped with respect to the first pulse in overall volume but that it also additionally be damped with respect to the first pulse in dependence upon the sound frequency, it being possible to damp especially the high sound frequencies and also, to a lesser extent, the low frequencies, that is to say, the bass frequencies. As a result, the naturalness of the reproduction is quite critically improved which may possibly be attributed to the fact that in the case of the direct immediate hearing of a sound event, sound waves arriving obliquely from the side will reach one ear directly but must pass somewhat around the head in order to reach the other ear and in this diffraction are damped in dependence upon the frequency.

In a device for carrying out the process described above it is possible to provide arrangements that allow the damping of the second pulse with respect to the first pulse in dependence upon the frequency to be so adjusted that the reproduction sounds the most natural. By this means it is possible to take into account differences in the shape of the head and the ear which have formed the individual sense of hearing of the listener. It is conceivable that a device or an apparatus for carrying out the process described above could be assigned several manually adjustable damping elements that either are permanently installed and can be switched over or are constructed so as to be removable by means of a plug-in connection with the result that the device may be used by several persons without it being necessary to make a fresh individual adaptation every time. A switch over would simply be made to the damping device already adjusted for the particular user.

When pulses (direct sound pulses) come simultaneously from both channels of the sound carrier, at least the first individual reflections emitted by the reverberation producer, corresponding in each case to one channel of the sound carrier, can be separated from one another by at least 1.5 ms, preferably 4 ms, in order to be perceived by the listener as individual reflections. Advantageously, the first pulse emitted by the reverberation producer is emitted at least 10 ms, preferably 10 to 25 ms, and especially 15 to 20 ms, after the pulse (direct sound pulse), coming from the sound carrier, that triggers it. The individual reflections emitted in the first 50 ms can be produced with a time arrangement and volume and with the apparent direction effected by the time interval between the individual pulses of the reflections such that they simulate an actually measured reproduction room by reproducing its reverberation behaviour.

Subsequent to the period of 50 ms the reverberation producer can produce a statistic reverberation. This is a tight sequence of sound pulses that are no longer perceptible as individual pulses but, as a cluster, imitate the exponential dying away of an oscillation set up in a room.

Each of the sound-intense individual reflections produced in the 50 ms range can therefore consist of two separate sound signals or pulses which are beamed over the two channels of the reproduction device at different volumes and with additional frequency-dependent damping. The two sound signals have a time interval between them which lies in the region of the time delay between the arrival of a sound at one ear of the listener and its subsequent arrival at the other ear. This time is so short that the sound signals are still perceived as an individual reflection, this reflection being perceived as having a direction according to the time interval between the sound signals that form it. When listening via headphones this has the result that the unpleasant sensation of having the source of the sound, for example an orchestra, in the head disappears and the sound event is perceived physiologically as being projected in front of the listener. In addition to individual reflections of that type, reflections that come from one channel of the sound carrier can be spread out equally strongly but relatively quietly over both channels of the reproduction device, that is to say, they are beamed out in mono, and by reason of their low volume they appear to the listener to come from behind or from above. The reverberation producer is preferably so arranged that the sound-intense individual reflections that it produces within the first 50 ms are identical in time spacing and volume to reflections occurring in a real room. By so doing the reverberation decreases approximately exponentially after the emission of the direct sound.

The reproduction process described above and the reverberation producer arranged to carry out this process have the great advantage not only that a spatial sound reproduction that is felt to be natural is achieved when using sound recordings that are recorded dry, completely without reflections of the recording room, for example only with sound pick-ups directly on the bodies of the musical instruments, but also that with this process it is possible to reproduce all sound recordings made with more or less reverberation without disadvantages arising. On the contrary, it is rather that the reproduction is optimised in each case. Dummy head recordings may also be played using this reproduction process, poor dummy head recordings being improved and good dummy head recordings not being impaired. With all sound recordings, but preferably with those recorded without the reverberation of the recording room, it is possible, even in the case of reproduction by means of headphones, to hear a transparent acoustic pattern that is localised outside the head, as in the case of the reproduction of good dummy head recordings. Even mono recordings are heard spatially, as if listening to a mono loud speaker situated in front of the listener in an acoustically good room.

The invention will be described in more detail in the following by way of embodiments and referring to schematic drawings.

Figure 2:
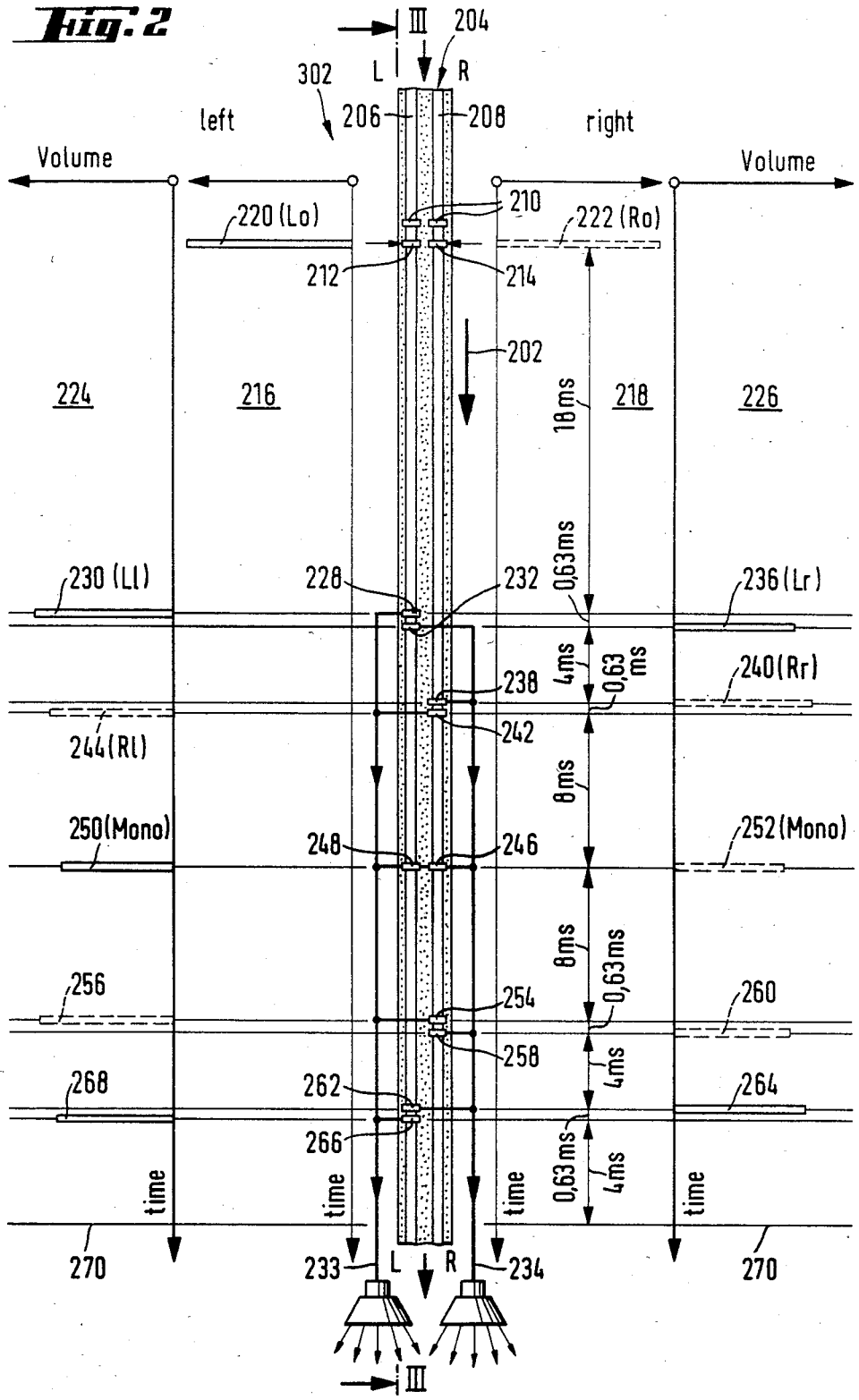
Figure 3:
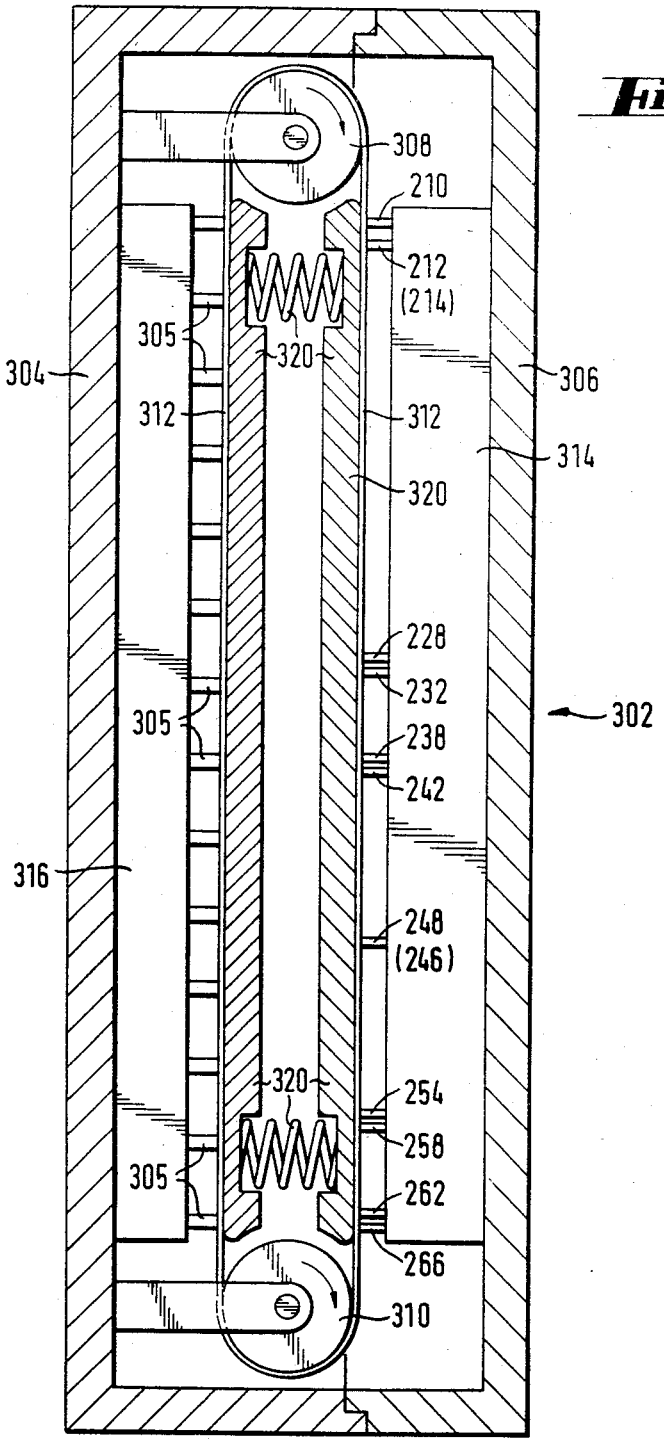
Figure 4:
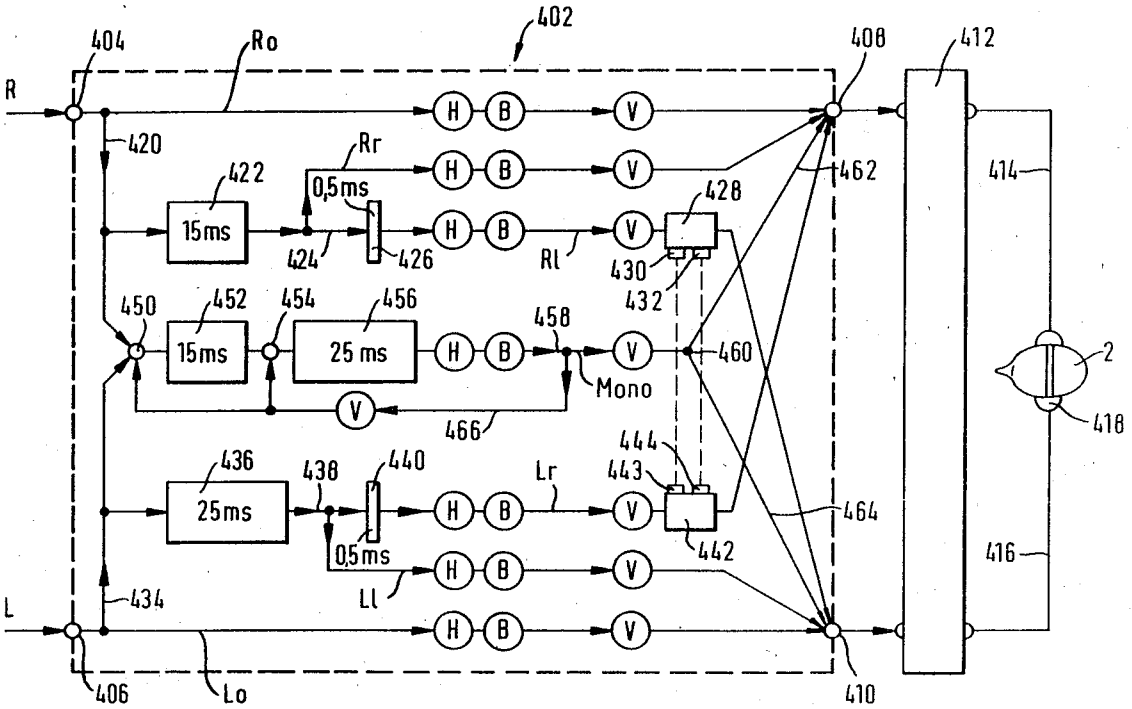

FIGS. 1*a* to 1*e* shows views of the incidence of sound on a human head, FIG. 2 shows schematically in a time/volume diagram the first sound-intense individual reflections supplied by a reverberation producer and a highly schematised view of a device for producing the individual reflections, FIG. 3 shows a side view in vertical section of a structural embodiment of a reverberation producer already shown in highly schematised form in the centre of FIG. 2, and FIG. 4 shows a modified embodiment of a reverberation producer.

FIG. 1*a* shows the head 2 of a listener with the right ear 4 and the left ear 6 and, indicated by arrows 8, the different angles of incidence at which the direct sound is perceived in the case of reproduction with headphones (not shown). The listener has the impression that the different direct sound pulses are incident at different angles of incidence over 180° from the extreme right to the extreme left, the apparent angles of incidence that occur being dependent upon the type of recording of the sound carrier. It has been shown that in the case of reproduction with headphones, these angles of incidence of the direct sound, which are distributed over approximately 180°, give the sensation of being in the audience, which is especially important because the visual impressions, for example of an orchestra, are of course missing in the case of the reproduction of a sound carrier.

FIG. 1*b* shows the acoustically desirable angles of incidence of the first, individually perceived sound reflections which are inclined with respect to the direction of vision at an angle of approximately 45°. Rr and Rl represent a wave front apparently coming from the front right, Rr representing direct incidence in the right ear and Rl representing the incidence in the left ear after diffraction at the head. Correspondingly, Lr and Ll represent a wave front that is incident from the left at an angle of 45°. A further wave front of an individual reflection appears to come from behind or from above. These apparent directions of sound incidence of which the production will be described in the following correspond to the impression made on the listener in a good concert hall in approximately the fifth row of seats, outside the reverberation radius, where a localisation of the sound sources by way of the direct sound is certainly still possible but the acoustic impression of the room already predominates. This is generally considered to be the ideal listening position.

FIG. 1*c* again shows the head 2 in conjunction with statistic reverberation, indicated by arrows 10, which is apparently incident from all directions.

FIG. 2 represents a process which shows how to produce with a reverberation producer sound-intense individual reflections that the listener feels are directed towards him. At the same time FIG. 2 shows a highly schematised view of a device for carrying out the process which shows schematically the construction of a suitable reverberation producer. A reverberation producer operating according to this process is required in order to produce a reverberation that is as natural as possible when reproducing sound carriers having unfaded recordings by means of headphones or loud speaker boxes having a strongly directed beam. In the centre of the Figure there is shown a magnetic sound tape 204 running quickly from above to below in the direction of arrow 202, which has a left sound track 206 and a right sound track 208 and, as a fast-running magnetic tape loop, forms part of a reverberation producer. In the direction of running, behind two erasing heads 210 there are arranged recording sound heads 212 and 214 of which the left 212 plays the signal coming from the left sound track of the sound carrier onto the tape 204 while the right plays the signal coming from the right sound track of the sound carrier onto the tape. In diagrams 216 and 218, shown immediately to the right and left of the tape 204, the pulses coming from the sound carrier are entered in volume against time, the signal of the left channel being shown in continuous lines and the signal of the right channel being shown in dotted lines. The same mode of representation is used for all pulses originating from the right or left sound carrier or magnetic tape channel 212 or 214 respectively. Purely for the purposes of clarification, the example shown is based on two pulses, indicated by the reference numeral 220 in the left channel and by the reference numeral 222 in the right channel, which are of equal intensity and occur simultaneously in both channels. Adjacent to diagrams 216 and 218, towards the outside, there are corresponding diagrams showing the reflection pulses produced by the reverberation producer and based on the input pulses described. The diagram for the left channel of the reproduction devices is indicated by the reference numeral 224 and the diagram for the right channel of the reproduction devices by the reference numeral 226. At a distance from the recording heads 212 and 214 that, corresponding to the speed of the tape, corresponds to a time span of 18 ms, there is arranged above the left sound track a sound pick-up head 228 which produces in the left output channel 232 a signal 230 of which the volume, corresponding to natural reverberation, is somewhat quieter than the direct reproduction pulse 220. At a distance behind that corresponds to a time span of 0.63 ms, there is arranged a second sound pick-up head 232 which, when the recording of the direct sound 220 passes through, emits into the right output channel 234 a pulse 236 which is somewhat weaker than the pulse 230 previously emitted into the left channel. The listener hears, for example by means of headphones, first of all the stronger pulse 230 in his left ear and then, 0.63 ms later, the somewhat pulse 236 in his right ear, with the result that he gains the impression that a sound wave coming from the left front has reached him, the wave having reached his left ear first of all and then, a short time later, his right ear, having been weakened by the "head shadow". As a result of the short time interval between them, these two pulses 230 and 236 are perceived not as separate pulses but as a sound-intense individual reflection incident from a direction. The next reverberation pulse produced by the reverberation producer from the input pulses 220 and 222 does not follow until 4 ms later so that it is not combined in the perception of the listener with the individual reflection consisting of pulses 230 and 236. At a distance from the sound head 232 that corresponds to 4 ms there is arranged above the right sound track 208 a sound pick-up head 238 which, when the recording of the direct signal 222 passes through, emits into the right output channel 234 a reverberation pulse 240 which corresponds in intensity substantially to pulse 230. At a distance behind the sound head 238 that corresponds to 0.63 ms there is arranged above the right sound track 208 a sound pick-up head 242 which emits into the left output channel 232 a pulse 244 of which the intensity corresponds approximately to that of pulse 236. Pulses 240 and 244 are combined in the perception of the listener to form an individual reflection that is apparently incident from the front right.

At a distance from the sound head 242 that corresponds to a time span of 8 ms there is arranged above the right sound track a sound pick-up head 246 and above the left sound track a sound pick-up head 248 which are short-circuited and are connected to the left output channel 232 and the right output channel 234 and process each recording that runs through in one or both tracks to form pulses 250 and 252 which are of equal intensity and are emitted into both channels, these pulses being somewhat weaker in volume that all the reverberation pulses described above. Because the pulses arrive simultaneously at the listener and have a lower volume, the listener perceives them as individual reflections coming from behind or from above. At a distance from these sound heads 246 and 248 that corresponds to 8 ms there is arranged above the right sound track 208 a sound pick-up head 254 which, when the recording of the direct pulse 222 passes through, emits into the left output channel 232 a pulse 256 which is again somewhat louder or, as an electrical signal, somewhat stronger than the previous pulses 250 and 252 but, corresponding to the natural fading of sound intensity, is quieter or weaker than the first reverberation pulse 230. At a distance that corresponds to a time span of 0.63 ms, behind the sound pick-up head 254 there is likewise arranged above the right sound track 208 a sound pick-up head 258 which emits into the right output channel 234 a pulse 260 which is weaker than the pulse 256 in the left channel coming shortly before and thus, as described, together with pulse 256 is perceived by the listener as a sound-intense individual reflection coming from the left or from the front left. At a distance from the sound head 258 that corresponds to a time span of 4 ms there is arranged above the left sound track 206 a sound pick-up head 262 which emits into the right output channel 234 a pulse 264 which corresponds in intensity to pulse 256. At a distance that corresponds to a time span of 0.63 ms, behind this sound head 262 there is arranged a sound pick-up head 266 which emits into the left output channel 232 a pulse 268 which corresponds in intensity to pulse 260. The two last-mentioned pulses 264 and 268 are again perceived by the listener as an individual reflection apparently coming from the right or from the front right.

The last pulse 268 is followed at a distance of 4 ms by a customary statistic reverberation, as produced also by known reverberation apparatus, which consists of a tight sequence of sound pulses which are no longer perceptible as individual reflections but, as a cluster, imitate the exponential drying away of an oscillation set up in a room. This statistic reverberation, which is not shown in the diagram in FIG. 2, follows after line 270 in the diagrams can be produced, for example, by a larger number of further sound heads, or alternatively by other known time delay devices such as capacitor chains. Instead of using a sound tape 204 and sound heads, the individual reflections described with reference to FIG. 2 may of course also be produced by means of other known devices in analogue or digital techniques. The time intervals between the individual reflections produced and the intensity thereof should correspond to the reverberation conditions in a real room, for which purpose the reverberation behaviour in this real room should be measured and the reverberation producer correspondingly designed. An average living room should preferably be taken as the room to be imitated. The reverberation producer can also be so designed that it can produce reverberation corresponding to two or more different real rooms so that, by switching over, the listener can move into the desired reproduction room, it being preferable to select a room corresponding to the room in which the listener is situated when listening. The reverberation producer should in any case be so designed that the first sound-intense reverberation-individual reflection is emitted at least 12 ms, preferably approximately 18 ms, after the direct sound so that it does not disturb the perception of the transient effects of the sound producers, such as, for example, musical instruments, in the direct sound.

The pulses 236 and 244, which are in each case the second pulse, of the individual reflection that are composed of two single pulses with a time interval between them, are in each case damped with respect to the first pulse not only in overall volume but also are additionally damped especially in the trebles and also, to some extent, in the basses in order to take into account the diffraction at the head (cf. FIG. 1*b*). The coordination of the level and the frequency-dependent damping of the direct sound, the first sound-intense individual reflections and the reverberation with one another and the damping of the second pulse of the composite individual reflections in order to take into account the shape of the human head ensure the easy recognition of stimulus patterns stored in the human brain and determine the directionally accurate and spatial definition of the sound event corresponding to the real acoustic conditions. Tests have shown that with the psycho-acoustic correct imitation of the direct sound and with two sound-intense individual reflections from the front left and the front right in conjunction with a third from the front above and subsequent reverberation it is possible to produce a remarkable spatial effect and transparency of the musical event. In the illustration according to FIG. 2 this corresponds to the direct sound pulse 220 and 222, the pulses 230, 236, 240, 250 and 252, which illustrate the individual reflections, and the subsequent statistic reverberation (not shown).

Instead of the individual reflections, which in order to achieves a sensation of direction consist of two pulses having a time interval of 0.63 ms between them, it is also possible to emit over the right and left output channels of the reproduction apparatus two simultaneous reverberation pulses that are picked up from the magnetic tape by a sound pick-up head, the impression of a directed incidence the sound likewise being achieved if, as described for the separate pulses, these pulses have different volumes and different frequency-dependent damping.

FIG. 3 shows a possible structural embodiment of the reverberation producer 302 already shown schematically in detail in the centre of FIG. 2, in which in a housing 304 having a lid 306 a magnetic sound tape 312 having two sound tracks is guided by means of two rollers 308 and 310, one of which is driven by an electric motor (not shown). On the lid there is secured a sound pick-up block 314 to which these are attached, one behind the other at the distances described with reference to FIG. 2, the erasing heads 210, the recording heads 212 and 214, and the pick-up heads 228, 232, 238, 242, 246, 248, 254, 258, 262 and 266. On the lower part of the housing 304 there is attached a sound pick-up block 316 which cooperates with the underside of the sound tape loop 312 and has sound pick-up heads lying close together which produce the statistic reverberation. In order to bring this block closer to the last pick-up head 266 for recording an individual reflection, the roller 310 can also be considerably smaller or a deflecting edge can be used in its place. Between the sound heads and inside the tape loop 312 there is mounted a spring-loaded pressing mechanism 320 for pressing the tape against the sound heads. The electrical circuit of the sound heads can be seen from FIG. 2.

FIG. 4 shows, enclosed by a dotted line, a modified reverberation apparatus 402 having a right input 404 and a left input 406, which are connected to a preamplifier (not shown), and a right output 408 and a left output 410 which are connected to an amplifier 412 to which stereophonic headphones 418 are connected by way of lines 414 and 416. The signals arrive at the input terminals 404 and 406 as they were picked up from the sound carrier. A line $R_0$ passes through from the input terminal 404 directly to the output terminal 408, there being arranged in this line only damping elements H for the trebles, B for the basses and V for the overall volume which serve for adjustment when the apparatus is manufactured. If the manufacturing tolerances are small enough these damping elements, like all other similar damping devices provided in the apparatus, can be replaced by non-adjustable damping elements that are adapted to the individual lines. Input 406 is directly connected via a line $L_0$ to the output 410 which, like output 408, is constructed in the form of a junction point amplifier and allows the signal to pass only in the direction of the arrows on the incoming lines. Interconnected in the line $L_0$ there are again damping devices for the volume, the trebles and the basses. A line 420 leads from the input terminal 404 to a delay member 422 in the form of a delay line which delays the incoming signal by 15 ms in order to produce the first individual reflection consisting of the two pulses Rr and Rl. A line Rr having interconnected damping elements H, B and V leads directly from the time function element 422 to the right output 408. In addition the output of the delay member 422 is connected by way of a line 424 to a delay member 426 which causes a timedelay of 0.5 ms and leads the second pulse Rl of the first single reflexion to the output 410 by way of line Rl with interconnected adjustment damping elements H, B and V and a manual regulator 428. The manual regulator 428 is provided with a trebles adjustor 430 adjustable by hand and a bass adjustor 432 adjustable by hand which enable an additional adjustment of the damping of the trebles and the bass in order to adapt them to different hearing perceptions according to different head shapes of the listeners. Adjustment damping elements H, B and V, which are interconnected in line Rl, have been adjusted during their production in such a manner that the trebles and to a certain extent the bass of the second pulse Rl are damped compared with the first pulse Rr. Instead of the damping elements H and B an adjustable cam filter can be provided which enables a more pricise adaption to the dampings, which result from a flexion on the head, and thereby increases the naturalness. Correspondingly, the manual regulator 428 can be provided with several positions for several frequency ranges.

A line 434 leads from the left input to a time function element 436 where the signal is delayed by 25 ms and then delivered to a line Ll which leads by way of damping elements to the left output 410 and provides this with the first pulse of the second individual reflection. For producing the second pulse, a line 438 leads from the output of the time function element 436 to a time function element 440 which effects a delay of 0.5 ms. From the output of time function element 440 a line Lr leads via adjustment dampers H, B and V and a manual damping regulator 442 to the right output 408. The manual regulator 442 has a treble adjustor 443 and a bass adjustor 444 which, as indicated by dotted lines, are connected to the corresponding adjusting elements 430 and 432 of the manual damping regulator in the line Rl, in order that they are operated together since, in general, the shape of the head can be assumed to be symmetric. The delay of 0.5 ms has the effect that each of the individual reflections is perceived at an angle of 45° measured with respect to the direction of vision. Smaller time delays effect smaller angles of incidence and larger time delays effect larger apparent angles of incidence. The lines 420, 434 which branch off from the outputs 404 and 406 lead to a junction point amplifier 450 which is connected to a time function element 452 that has a time delay of 15 ms. The output of this time function element is connected via a junction point amplifier 454 to a time function element 456 which has a time delay of 25 ms and, with the interconnection of damping elements H, B and V, is connected via a line 458 to a branching point 460 from which a line 462 leads to the right output 408 and a line 464 leads to the left output 410. Between damping elements B and V there branches off from the line 458 a line 466 which leads via a damping element V for the overall volume level to the junction point amplifiers 454 and 450 in front of and behind the time function element 452. This circuit consisting of the two time function elements 452 and 456 and the feedback line 466 has the effect that 40 ms after the incidence of the direct sound a mono individual reflection is emitted which is felt to come from behind or from above. As a result of the action of the feedback line 466, a further mono reflection is emitted 25 ms later and subsequently, at ever decreasing intervals, mono reflections are emitted which together form the statistic reverberation. The strength of the damping of the damping element V in the line 466 and the amplification of the junction point amplifiers 450 and 456 must be coordinated with one another in such a manner that the reflections die away exponentially. In all, all the damping elements H, B and V are so adjusted that from the direct sound onwards the reverberation produced as a result, which consists of the individual reflections and the statistic reverberation, dies away exponentially.

The statistic reverberation is damped in the trebles and the basses with respect to the direct sound and the individual reflections, the damping increasing as the time interval from the direct sound increases.

In tests with the reverberation apparatus according to FIG. 4 the following adjustments to the adjustment damping element proved advantageous, the manual damping regulators 428 and 442 being in the neutral position:

| In the lines | Damping (db) H | B | V |
|---|---|---|---|
| Ro | +4 | 0 | −5.5 |
| Rr | 0 | 0 | −8 |
| Rl | −6 | −6 | −12 |
| Mono (458) | −2 | 0 | manually adjustable |
| Lr | −6 | −6 | −13 |
| Ll | 0 | 0 | −10 |
| Lo | +4 | 0 | −5.5 |

Unlike the embodiment according to FIG. 4, the damping element V in the line 458 (mono) could be adjusted manually in order to influence the intensity of the statistic reverberation. It is advantageous to adjust the damping element V in the feedback line 466, which element determines the duration of reverberation, at the same time. With these adjustments it is possible to a certain extent to influence the room that is perceived with regard to liveness and size.

The preemphasis of the trebles in lines $R_0$ and $L_0$ for the direct sound improves the localisation ability, for example of the instruments, without rendering the total reproduction unpleasantly shrill. In these tests, time function elements were used that had no transmission losses and observed the described delay periods very accurately. It is, of course, possible to achieve acceptable results with a certain amount of deviation from the above damping values and/or the damping relationship of the lines to one another, that is to say, the relationship between, for example, the treble damping in one line and the treble damping in a different line.

The damping occurring on diffraction at the head in the different frequencies of the wave fronts that are incident laterally from the desired direction, for example at an angle of 45° with respect to the direction of vision, can be measured in an anechoic room. They determine the basic adjustment of the damping elements in the lines Rr, Rl, Ll and Lr and the relationships of the damping of the lines for the first and second pulse of an individual reflection.

The reproduction can paradoxically sound more natural when the time sequence of the individual reflections and the commencement of the statistic reverberation and/or the damping relationships between the direct sound, the individual reflections and the statistic reverberation do not imitate the conditions of a given room. Thus, for example, the first reflection can, according to the Haas effect, be louder than the direct sound yet not be perceived or sensed as the direct sound, that is to say, this first reflection does not disturb the localisation of the sound event.

German Auslegeschrift (published application) 26 38 053 and the corresponding German Offenlegungsschrift 26 38 053 give detailed descriptions of the problems of sound reproduction and especially the significance of transient effects for clear musical reproduction and represent a part of the disclosure of the present application.

I claim:

1. A process for the reproduction of a sound recording using headphones as the reproduction device, comprising connecting between the sound carrier and the reproduction device a reverberation reproducer, producing reverberation reflections within a period of approximately 50 ms, at least some of which if triggered by pulses occurring simultaneously in both channels of the sound carrier are delivered at time intervals from each other so that they are perceived by the listener as sound-intense single reflections by themselves, triggering at least some of the single reflections consisting of two pulses by a direct sound pulse from a channel of the sound carrier and of which two pulses the first is emitted over the channel of the reproduction devices that is assigned to the corresponding sound carrier channel and the second is somewhat weaker and is emitted over the other channel of the reproduction devices with a time delay with respect to the first pulse of approximately 0.2 to 1 ms the reverberation reflections are damped in dependence upon the sound frequency, the production of a mono-single reflection being effected by both input terminals (404, 406) being connected to a common first delay device (452, 456) whose output is connected, by frequency-dependent damping filters (H, B, V), a line branch (460) and adding elements (node amplifiers 408, 410), to both output terminals (408, 410), and whose delay is greater than the respective delay of at least two first delay devices (422, 436) which participate in the production of single reflections consisting of two time-separated pulses.

2. Process according to claim 1, characterized in that the damping of the individual reflections can be regulated subsequently by hand.

* * * * *